US006984193B2

(12) United States Patent
Chen

(10) Patent No.: US 6,984,193 B2
(45) Date of Patent: Jan. 10, 2006

(54) LIFTING DEVICE OF A TREADMILL

(76) Inventor: Chia-Hsiang Chen, P.O. Box 2103, Taichung (TW)

( * ) Notice: Subject to any disclaimer, the term of this patent is extended or adjusted under 35 U.S.C. 154(b) by 0 days.

(21) Appl. No.: 10/751,973

(22) Filed: Jan. 7, 2004

(65) Prior Publication Data

US 2004/0142796 A1 Jul. 22, 2004

(30) Foreign Application Priority Data

Jan. 7, 2003 (TW) ..... 92200208 U

(51) Int. Cl.
*A63B 22/02* (2006.01)

(52) U.S. Cl. ..... 482/54
(58) Field of Classification Search ..... 482/51, 482/54
See application file for complete search history.

(56) References Cited

U.S. PATENT DOCUMENTS 6,261,209 B1 * 7/2001 Coody ..... 482/54
6,398,696 B1 * 6/2002 Tsou ..... 482/54
6,475,121 B2 * 11/2002 Wang et al. ..... 482/54
6,592,496 B1 * 7/2003 Tsou ..... 482/54
6,695,751 B1 * 2/2004 Hsu ..... 482/54

* cited by examiner

*Primary Examiner*—Stephen R. Crow
(74) *Attorney, Agent, or Firm*—Rosenberg, Klein & Lee

(57) ABSTRACT

A treadmill with a lifting device includes a main frame, a platform pivotally connected to the main frame and a lifting device mounted to the main frame and the platform. The lifting device includes a power supplier mounted to the main frame and a folding structure connected to the main frame and the platform. The folding structure includes a buckle device for holding the platform in place when the platform is fully lifted.

6 Claims, 9 Drawing Sheets

LIFTING DEVICE OF A TREADMILL

BACKGROUND OF THE INVENTION

1. Field of the Invention

The present invention relates to lifting device, and more particularly to a lifting device of a treadmill for folding the structure of the treadmill.

2. Description of Related Art

A conventional lifting device of a treadmill in accordance with the prior art shown in FIGS. 8 and 9 comprises base member (5) and a U-shaped connector (63) secured on a front portion of the base member (5). A main frame (6) is pivotally connected to two free ends of the U-shaped connector (62). A first motor (61) is mounted to the main frame (6) for driving an endless strap (62) that is mounted around the main frame (6). A linear driver (7) is mounted to a bottom of the main frame (6) and includes a telescopic rod (72) that is driven by a second motor (not shown). The telescopic rod (72) has a first end secured on the bottom of the main frame (6) and a second pivotally connected to a lift arm (8) that includes two opposite ends respectively pivotally connected to two opposite sides of the U-shaped connector (63). Two supports (not numbered) respectively extending from two opposite ends of the lift arm (8) and each having a roller (81) rotatably mounted on the free end thereof. The two rollers (81) are adapted to abut a supporting surface for lifting the front portion of the main frame (6). For folding the treadmill, the user only needs to directly lift the rear portion of the main frame (6) to make the two rollers (81) backward move over the gravity of the main frame (6) for reducing the volume of the treadmill during being stored.

To fold the treadmill with the conventional lifting device is a laborious work because the convention lifting device of a treadmill without auxiliary structure for effort-saving. However, the main frame of a treadmill is a very heavy element for children or weak user to lift.

There is no fastener for positioning the lifted main frame (6). The lifted main frame (6) may fall down and crash the supporting surface due to a sudden bump. Furthermore, the falling main frame (6) may hurt the user. It is very dangerous.

The length of the telescopic rod (72) is used to limit the position of the lift arm (8) when lifting the main frame (6) and the first end of the telescopic rod (72) is pivotally mounted on the bottom of the main frame (6) so that all the gravity of the main frame (6) focus on the pivotal portion between the telescopic rod (72) and the lift arm (6). As a result, the pivotal portion between the telescopic rod (72) and the lift arm (6) may be broken after the treadmill being used for a period of time.

The present invention has arisen to mitigate and/or obviate the disadvantages of the conventional lifting device of a treadmill.

SUMMARY OF THE INVENTION

The main objective of the present invention is to provide an improved lifting device of a treadmill. The lifting device can stably position the lifted platform of the treadmill.

To achieve the objective, the treadmill includes a main frame and a platform pivotally connected to the main frame the main frame having two side rods corresponding to each other and a lateral rod laterally connecting the two side rods. Each side rod has a slot defined in inner side of a rear portion of each of the two side rods. The lifting device is mounted to the main frame and the platform, and comprises a power supplier pivotally mounted to the main frame. The power supplier includes a telescopic rod having a first end pivotally connected to the lateral rod of the main frame and a second end pivotally connected to a front portion of the main frame. A power source is mounted on the telescopic rod for driving the telescopic rod. Two arms are respectively pivotally connected to two opposite outer sides of a front portion of the platform and an inner side of each of the two side rods of the main frame. A folding structure is connected to the main frame and the platform. The folding device includes two rods each connected to the platform and the main frame. Each rod includes a first end having a shaft laterally extending therethrough and a second end pivotally mounted to a corresponding one of the two side rods of the main frame. Each shaft has a free end slidably received in a corresponding one of the two slots in the two side rods of the main frame. A buckle device is securely on the lateral rod for selectively positioning a corresponding one of the two shafts when lifting the platform.

Further benefits and advantages of the present invention will become apparent after a careful reading of the detailed description with appropriate reference to the accompanying drawings.

DETAILED DESCRIPTION OF THE INVENTION

Figure 1:
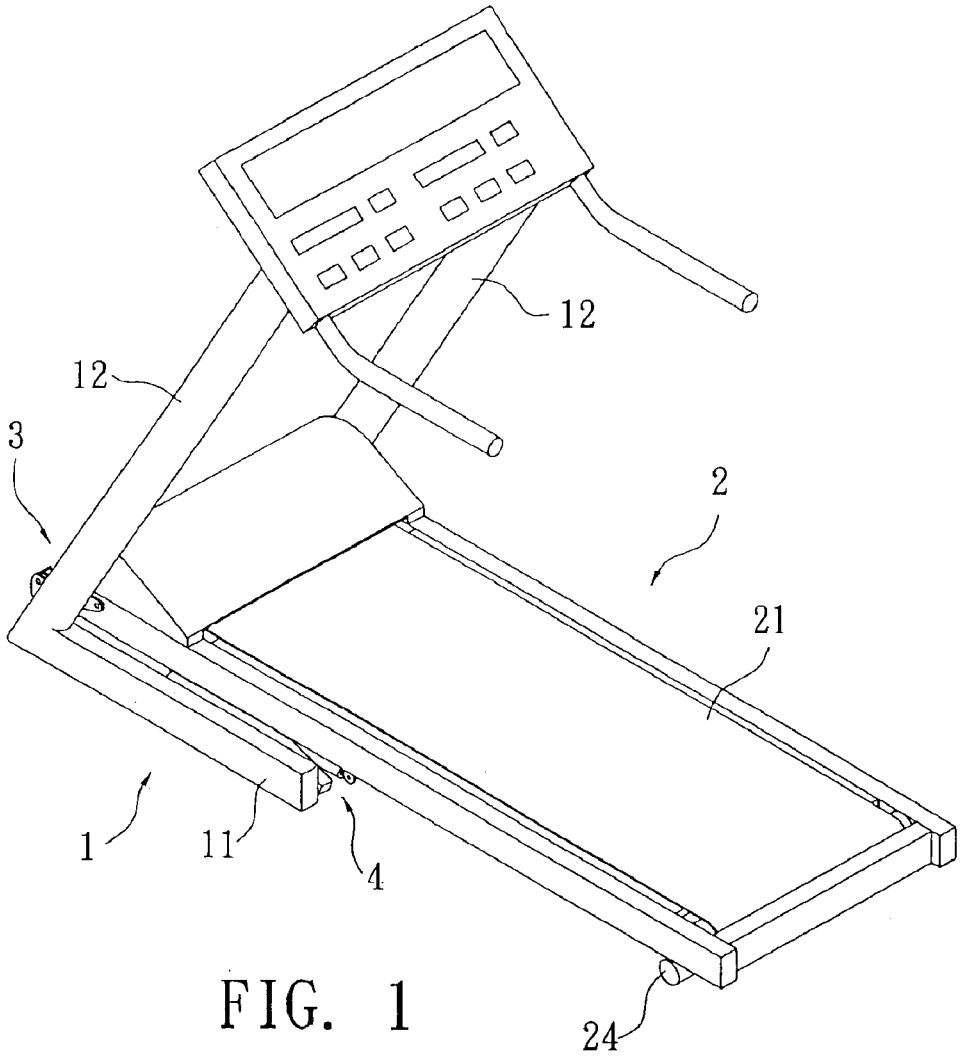
FIG. 1 is a perspective view of a treadmill with a lifting device in accordance with the present invention.
Figure 2:
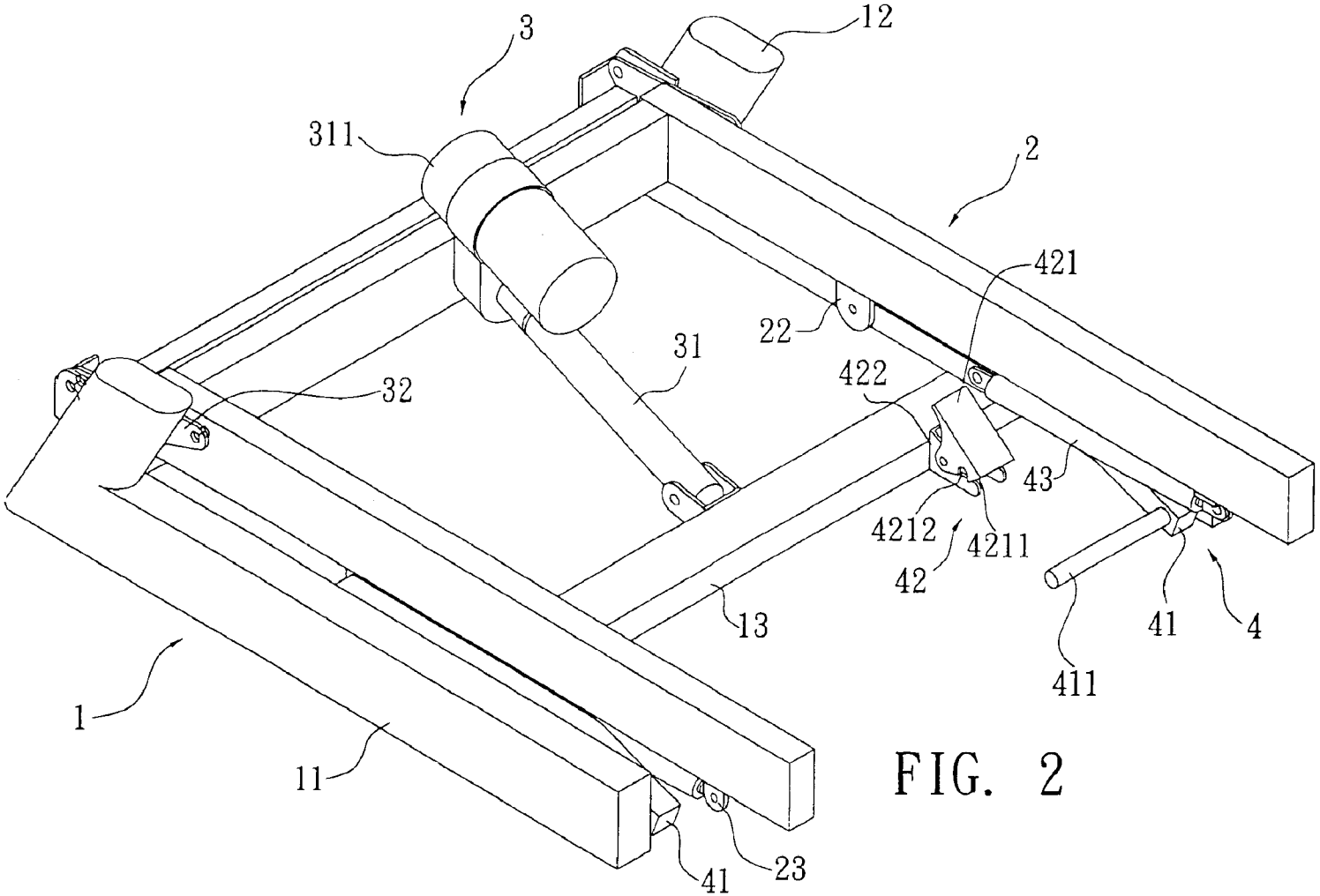
FIG. 2 is a perspective view of the lifting device of a treadmill in accordance with the present invention.
Figure 3:
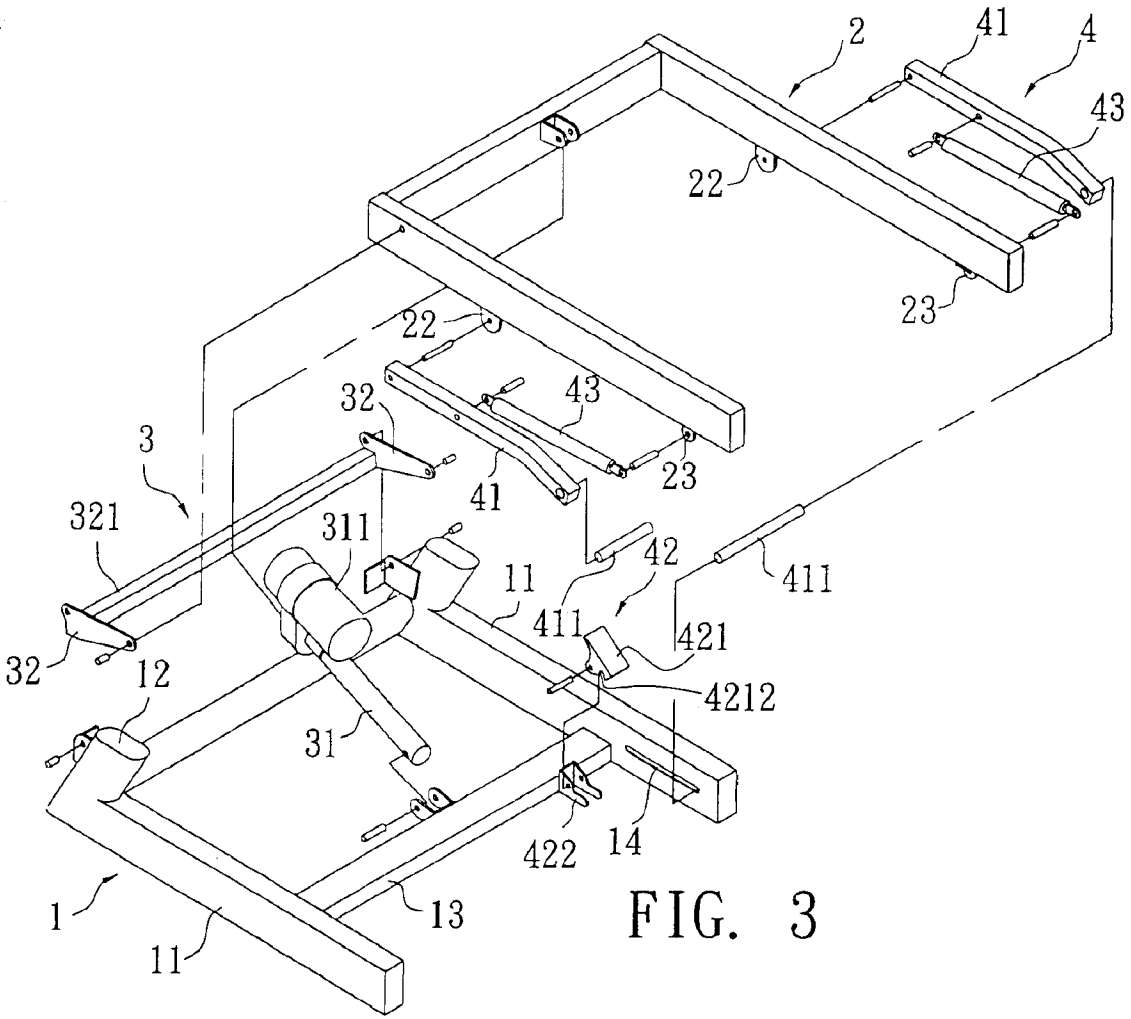
FIG. 3 is an exploded perspective view of the lifting device in FIG. 2.

Referring to the drawings and initially to FIGS. 1–3, a treadmill with a lifting device in accordance with the present invention comprises a main frame (1), a platform (2) pivotally connected to the main frame (1) and a lifting device mounted to the main frame (1) and the platform (2). The lifting device includes a power supplier (3) mounted to the main frame (1) and a folding structure (4) connected to the main frame (1) and the platform (2).

The main frame (1) includes two side rods (11) corresponding to each other and a lateral rod (13) laterally secured to the two side rods (11). A stand (12) upwardly extends from a front end of each of the two side rods (11). Each side rod (11) includes a rear end having a slot (14) defined in an inner side of each of the two side rods (11). The two slots (14) face each other.

The platform (2) has a front portion pivotally connected to the main frame (1) within the two side rods (11). An endless strap (21) is mounted around the platform (2) for user to take an exercise thereon. A pair first ears (22) and a pair of second ears (23) downward extend from a front portion of each of two opposite sides of the platform (2). A distance between the pair of first ears (22) and the front end of the main frame (1) is shorter than that between the pair of second ears (23) and the front end of the main frame (1). The platform (2) includes two rollers (24) respectively rotatably mounted to two opposite sides of a rear portion of the platform (2).

The power supplier (3) includes a telescopic rod (31) having a first end pivotally connected to the lateral rod (13) and a second end pivotally connected to a front portion of the platform (2). In the preferred embodiment of the present invention, the telescopic rod (31) is a threaded rod and driven by a power source (311). In the preferred embodiment of the present invention, the power source (311) is a motor with a speed reducer. Two arms (32) are respectively pivotally connected to two opposite outer sides of the front portion of the platform (2) and the inner side of each of the two side rods (11). A connecting rod (321) has two opposite ends each secured on a corresponding one of the two arms (32) for enhance the strength of the two arms (32).

The folding device (4) includes two rods (41) each connected to the platform (2) and the main frame (1). Each first rod includes a first end having a shaft (411) laterally extending therethrough and a second end pivotally mounted to a corresponding one of the pair of first ear (22). Each shaft (411) has a free end slidably received in a corresponding one of the two slots (14) in the two side rods (11) of the main frame (1). Two auxiliary rods (43) each has a first end pivotally mounted to a corresponding one of the pair of second ears (23) and a second end pivotally mounted to a middle portion of each of the rods (41). In the preferred embodiment of the present invention, the auxiliary rod (43) is an air spring. A buckle device (42) is securely on the lateral rod (13) for selectively positioning a corresponding one of the two shafts (411). The buckle device (42) includes a pivot seat (422) secured on the lateral rod (13) and a pedal (421) pivotally mounted to the pivot seat (422). The pedal (42) includes a guiding portion (4211) formed facing the corresponding one of the two shafts (411) and a groove (4212) defined near the guiding portion (4211) for positioning the corresponding one of the two shafts (411) when the platform (2) is vertically lifted.

Figure 4:
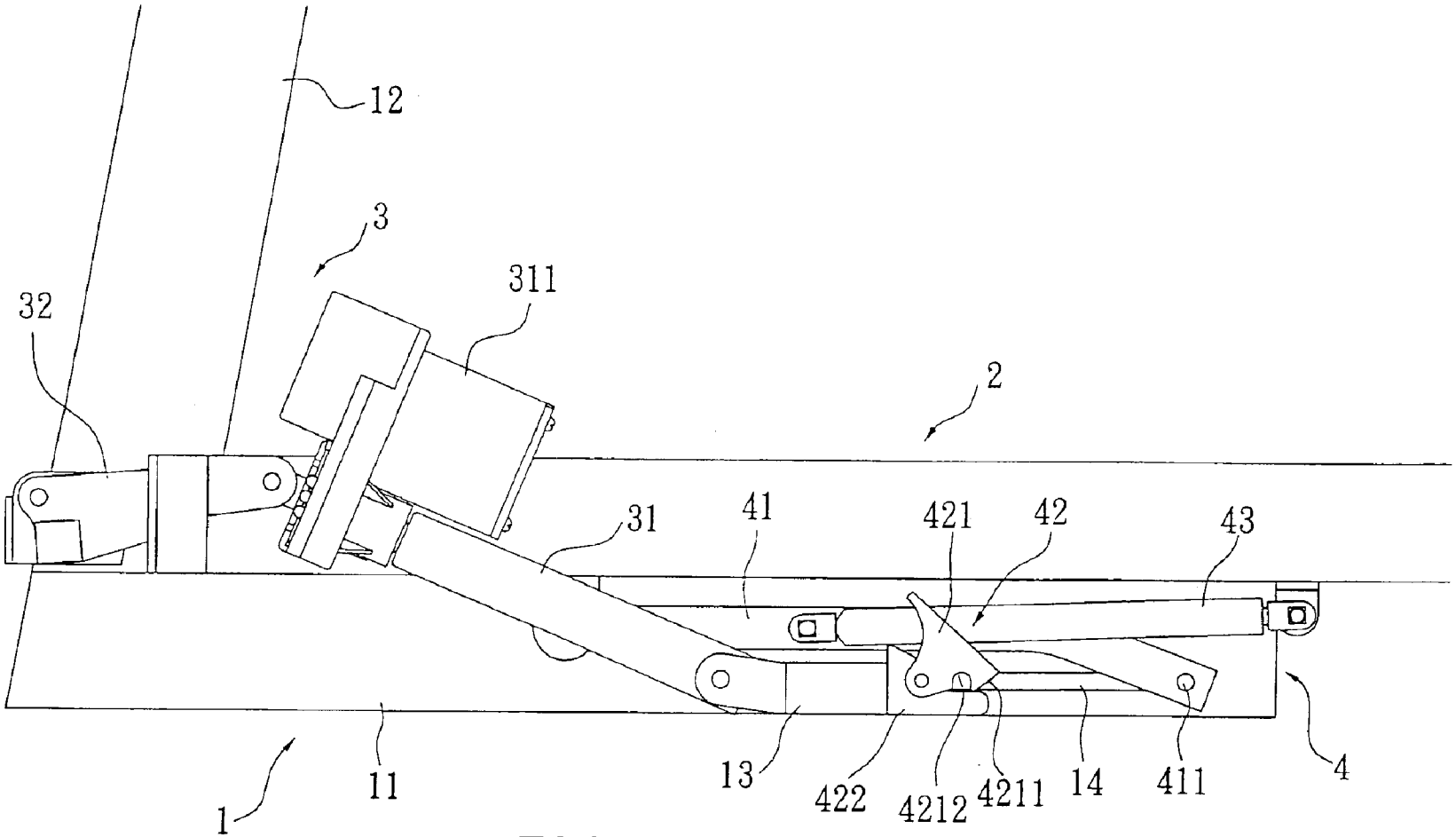
FIG. 4 is a side plan view of the lifting device in FIG. 2.
Figure 5:
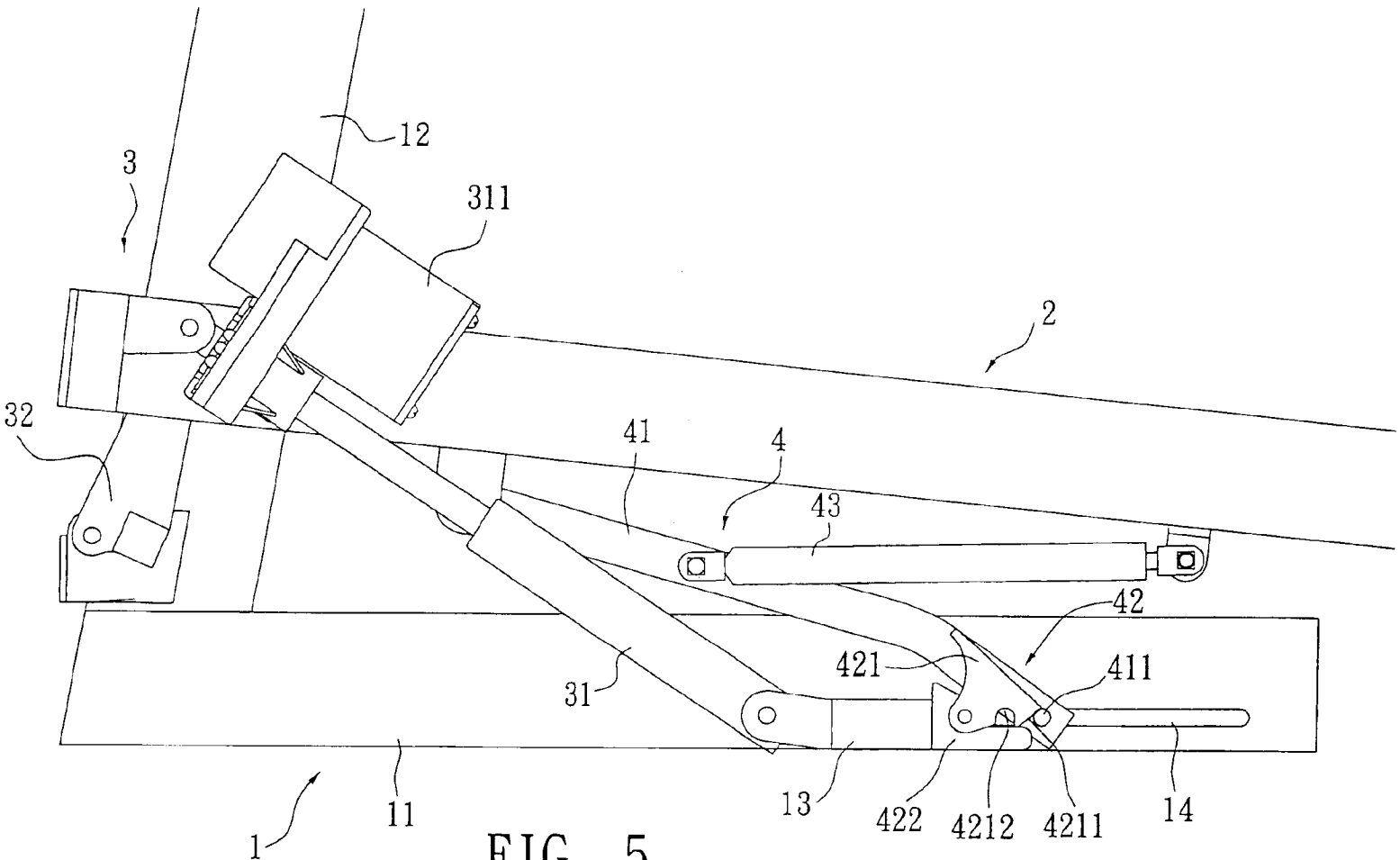
FIG. 5 is a first operational side plan view of the lifting device of the present invention.

With reference to FIGS. 4 and 5, the two opposite ends of the telescopic rod (31) are respectively pivotally connected to the front portion of the platform (2) and the lateral rod (13) of the main frame (1), and the two opposite sides of the front portion of the platform (s) and the main frame (1) are pivotally connected by the two arms (32) so that the front portion of the platform (2) is lifted when the telescopic rod (31) extends due to the power source (311). The telescopic rod (31) and the two arms (32) form an angle for stably supporting the front portion of the platform (2) when the front portion of the platform (2) is lifted.

Figure 6:
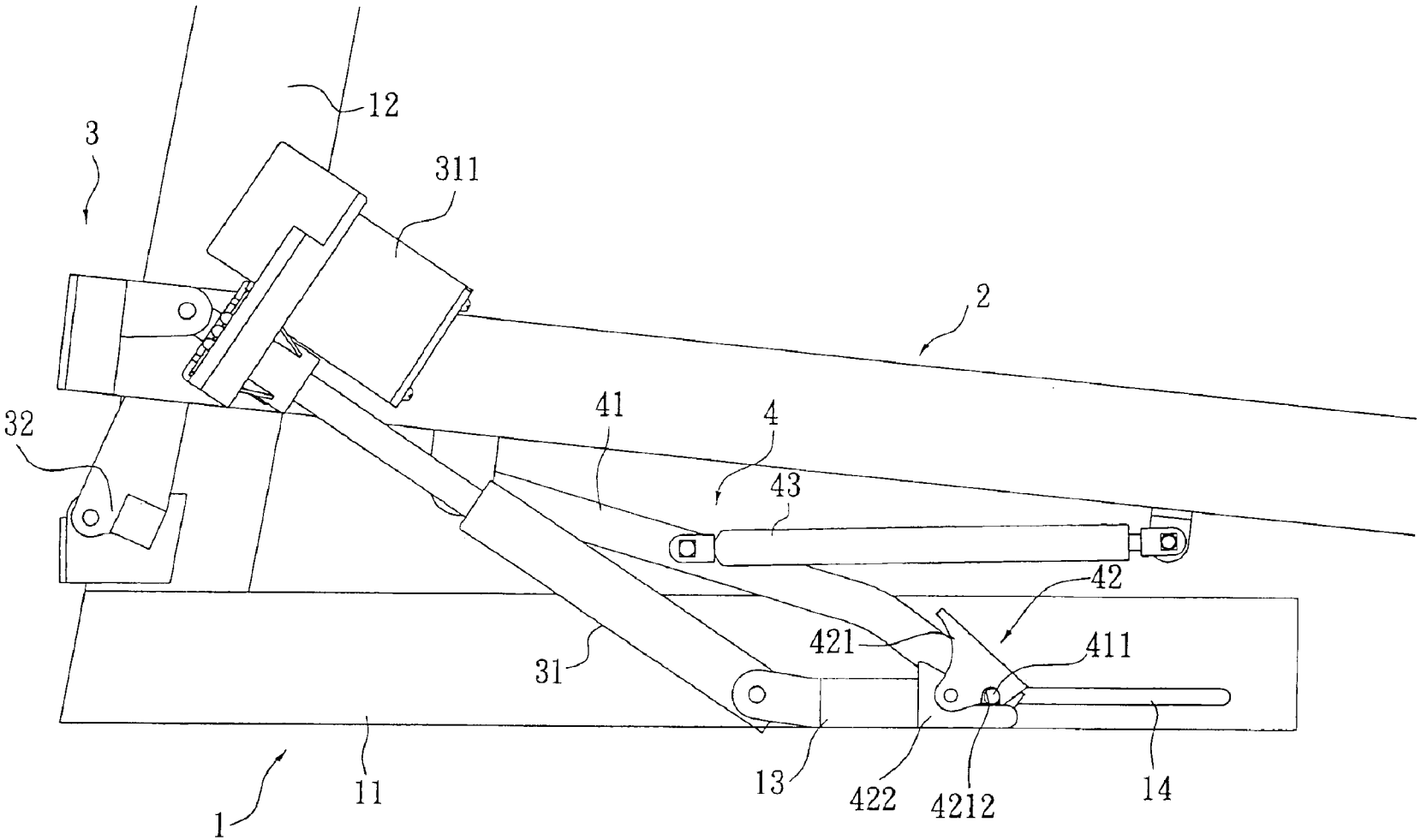
FIG. 6 is a second operational side plan view of the lifting device of the present invention.
Figure 7:
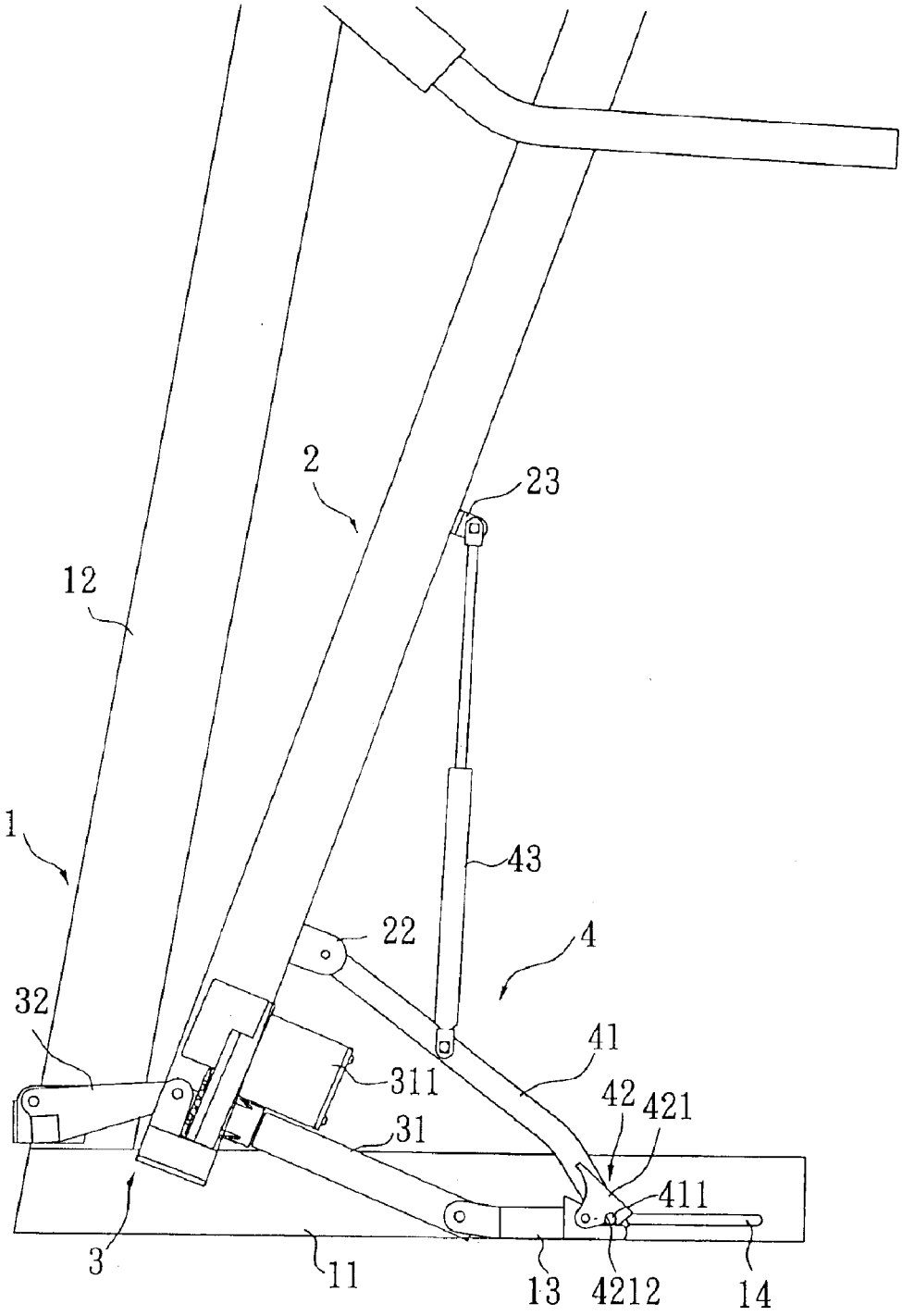
FIG. 7 is a third operational side plan view of the lifting device of the present invention.
Figure 8:
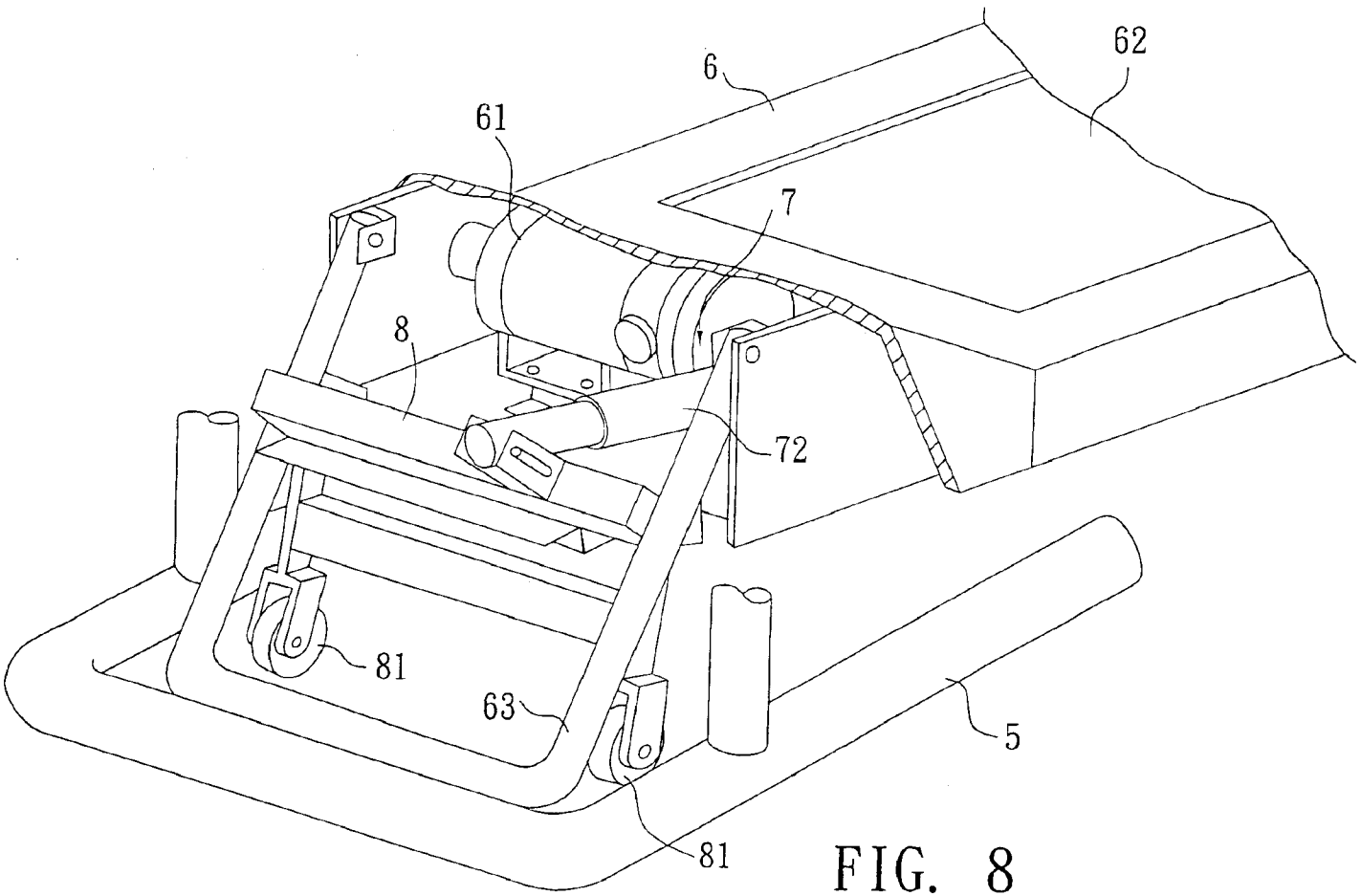
FIG. 8 PRIOR ART
FIG. 8 is a perspective view of a conventional lifting device of a treadmill in accordance with the prior art.
Figure 9:
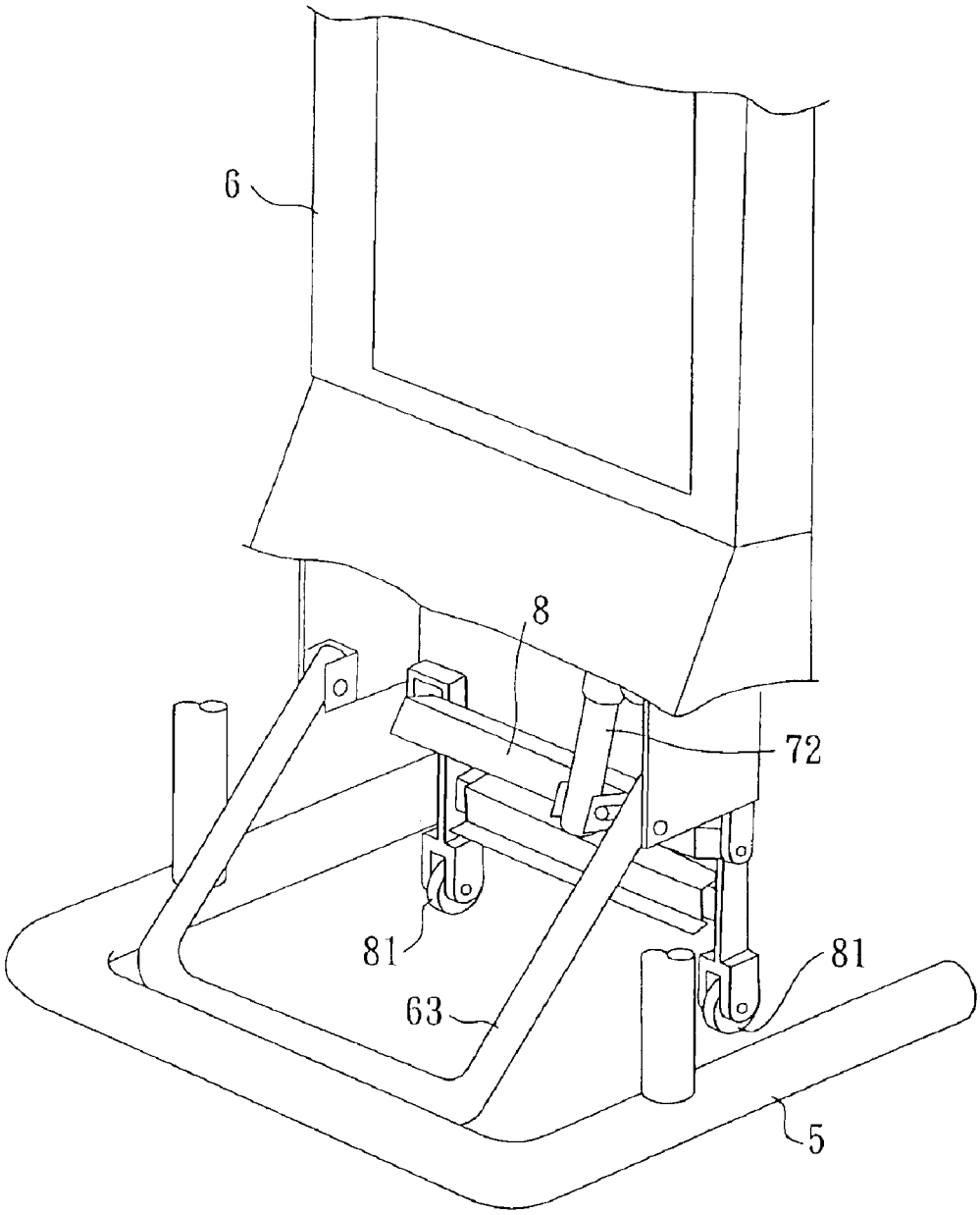
FIG. 9 PRIOR ART
FIG. 9 is an operational side plan view of the conventional lifting device in FIG. 8.

With reference to FIGS. 6 and 7, the telescopic rod (31) fully extends and the shaft (411) of the folding structure (4) is moved toward the buckle device (42) till the shaft (411) moved along the guiding portion (4211) and engaged in the groove (4212) in the pedal (42) when perpendicularly lifting the platform (2) to reducing the volume of the treadmill for storing the treadmill. At this time, shorten the telescopic rod (31) and the rear portion of the platform (2) is upwardly moved because the shaft (411) is positioned in the groove (4212). Consequently, the treadmill is folded by using electric power for effort-saving. The shaft (411) is positioned in the groove (4212) to prevent the platform (2) from suddenly falling.

The pedal (421) is stepped to make the shaft (411) be disengaged from the groove (4212) for putting down the platform (2). The two auxiliary rods (43) reduce the falling speed of the platform (2) for promoting the safety of the treadmill when putting down the platform (2) of the treadmill.

Although the invention has been explained in relation to its preferred embodiment, it is to be understood that many other possible modifications and variations can be made without departing from the spirit and scope of the invention as hereinafter claimed.

What is claimed:

1. A lifting device of a treadmill that includes a main frame and a platform pivotally connected to the main frame, the main frame having two side rods corresponding to each other and a lateral rod laterally connecting the two side rods, each side rod having a slot defined in an inner side of a rear portion of each of the two side rods, the lifting device mounted to the main frame and the platform, and comprising:

a power supplier pivotally mounted to the main frame, the power supplier including a telescopic rod having a first end pivotally connected to the lateral rod of the main frame and a second end pivotally connected to a front portion of the main frame, a power source mounted on the telescopic rod for driving the telescopic rod, two arms respectively pivotally connected to two opposite outer sides of a front portion of the platform and an inner side of each of the two side rods of the main frame; and a folding structure connected to the main frame and the platform, the folding device including two rods each connected to the platform and the main frame, each rod including a first end having a shaft laterally extending therethrough and a second end pivotally mounted to a corresponding one of the two side rods of the main frame, each shaft having a free end slidably received in a corresponding one of the two slots in the two side rods of the main frame, a buckle device secured on the lateral rod for selectively positioning a corresponding one of the two shafts when lifting the platform.

2. The lifting device as claimed in claim 1, wherein the power supplier comprises a connecting rod having two opposite ends each secured on a corresponding one of the two arms for enhancing the strength of the two arms, and the folding structure comprises two auxiliary rods each having a first end pivotally mounted to a corresponding one of two opposite sides of the platform and a second end pivotally mounted to a middle portion of each of the rods for reducing a falling speed of the platform when putting down the platform.

3. The lifting device as claimed in claim 2, wherein the auxiliary rod is an air spring.

4. The lifting device as claimed in claim 1, wherein the buckle device comprises a pivot seat secured on the lateral rod and a pedal pivotally mounted to the pivot seat, the pedal including a guiding portion formed facing a corresponding one of the two shafts and a groove defined near the guiding portion for positioning the corresponding one of the two shafts when the platform is vertically lifted.

5. The lifting device as claimed in claim 1, wherein the telescopic rod is a threaded rod.

6. The lifting device as claimed in claim 1, wherein the power source is a motor with a speed reducer.

* * * * *